United States Patent [19]

Fleissner

[11] 4,025,305

[45] * May 24, 1977

[54] PROCESS FOR THE HEAT-SETTING OF PADDED OR PRINTED CONTINUOUS SYNTHETIC FILAMENT GROUPS

[75] Inventor: Heinz Fleissner, Egelsbach near Frankfurt, am Main, Germany

[73] Assignee: Vepa AG, Switzerland

[ * ] Notice: The portion of the term of this patent subsequent to Apr. 17, 1990, has been disclaimed.

[22] Filed: Jan. 19, 1973

[21] Appl. No.: 325,092

Related U.S. Application Data

[63] Continuation of Ser. No. 676,780, Oct. 20, 1967, abandoned.

[30] Foreign Application Priority Data

Oct. 20, 1966 Germany ..... 1635102

[52] U.S. Cl. ..... 8/176; 68/5 D; 68/DIG. 5

[51] Int. Cl.[2] ..... D06P 5/02

[58] Field of Search ..... 68/5 D, DIG. 5; 8/175, 8/176

[56] References Cited

UNITED STATES PATENTS

| | | | |
|---|---|---|---|
| 246,547 | 8/1881 | Patterson et al. | 68/5 D |
| 2,663,612 | 12/1953 | Gibson | 8/176 |
| 3,098,371 | 7/1963 | Fleissner | 68/5.4 |
| 3,242,702 | 3/1966 | Fleissner | 68/5.4 |
| 3,288,551 | 11/1966 | Raff | 8/21 |
| 3,376,609 | 4/1968 | Kalwaites | 8/151.2 |
| 3,445,947 | 5/1969 | Fleissner | 68/DIG. 5 |
| 3,467,975 | 7/1967 | Fleissner | 68/DIG. 5 |
| 3,469,423 | 9/1969 | Fleissner | 68/DIG. 5 |
| 3,567,356 | 3/1971 | Der Eltz et al. | 68/DIG. 5 |
| 3,728,076 | 4/1973 | Fleissner | 68/5 D |

*Primary Examiner*—Benjamin R. Padgett
*Assistant Examiner*—B. Hunt
*Attorney, Agent, or Firm*—Craig & Antonelli

[57] ABSTRACT

The present disclosure relates to a process for the continuous pad-dyeing or printing of continuous synthetic filament groups with dyestuffs which are set under the influence of heat. More particularly, the present disclosure is directed to a process for the continuous pad-dyeing of synthetic filament groups wherein a heated treatment medium, for example air, is passed through the filament groups which have been printed or padded with the preparations containing the dyestuffs. By drawing heated air through the material being treated a completely uniform drying of the filament groups and also a uniform dyestuff setting is obtained and a migration of the dyestuffs is substantially avoided.

15 Claims, 3 Drawing Figures

Fig.2 Schnitt A-A

PROCESS FOR THE HEAT-SETTING OF PADDED OR PRINTED CONTINUOUS SYNTHETIC FILAMENT GROUPS

CROSS-REFERENCE TO RELATED APPLICATION

This is a continuation of application Ser. No. 676,780 filed Oct. 20, 1967, which application is now abandoned.

BACKGROUND OF THE INVENTION

The present invention relates to a process for the continuous pad-dyeing or printing of continuous synthetic filament groups, for example tows and slivers of synthetic staple fibers with dyestuffs which are set under the influence of heat.

General efforts to render production processes more economical and less expensive have resulted in an increasing use of the Thermosol process for dyeing synthetic materials, for example polyester fabrics and blends of polyester fabrics. The use of the Thermosol process for polyester fabrics and its blends, especially when it is blended with cellulose fibers, often results in difficulties if a number of requirements are not exactly complied with. Particularly important is the requirement of a sustantially uniform treatment temperature during drying and dyestuff setting. Temperature variations of about 2° to 3° C over the working width may lead to a varying coloration and thus render the material useless. Even the slightest of faults, such as uneven absorbency and/or bad wettability, lime precipitation, dirt and grease residues or creases become noticeable in dyeing and in most cases these faults cannot be redeemed. Thus for the Thermosol-dyeing of piece goods very exacting requirements are made regarding the pre-treatment and the conditions during the dyeing process proper. Since the Thermosol process is by far superior to the usual dyeing methods with a wet steam fixation or fixation in a liquid with respect to the economy of the process, the above-mentioned difficulties are tolerated.

SUMMARY OF THE INVENTION

An object of the present invention is to avoid the prior art disadvantages in the heat-setting of padded or printed continuous synthetic filament groups.

Another object of the present invention is to provide an improved process for dyeing continuous synthetic filament groups wherein the difficulties confronted in piece goods dyeing are substantially avoided.

Other objects and further scope of applicability of the present invention will become apparent from the detailed description given hereinafter; it should be understood, however, that the detailed description and specific 3xamples, while indicating preferred embodiments of the invention, are given by way of illustration only, since various changes and modification within the spirit and scope of the invention will become apparent to those skilled in the art from this detailed description.

Pursuant to the present invention, it has been found that the above-mentioned disadvantages may be eliminated and a much improved process for the heat-setting of padded or printed continuous synthetic filament groups and top slivers can be obtained if the synthetic fibers, for example polyester fibers are Thermosol-dyed in the form of top slivers or tow. Slight unlevelness or un-uniformity in dyeing are substantially compensated for since as in the spinning of yarn and in the making of piece goods that individual fibers are well mixed.

In accordance with the present invention it is suggested to dye synthetic filament groups and top slivers of synthetic fibers using the Thermosol process by passing a gas, preferably air which has been heated to a temperature of about 170° to 230° C through the filament groups or top slivers which have been printed or padded with the preparations which contain suitable dyestuffs and frequently thickeners and other common auxiliary agents. The filament groups or top slivers which have been printed or padded may possibly also be dried. It has been established through tests that by passing air, especially by drawing heated air through the material being treated a completely uniform drying of the filament groups and top slivers and also a uniform dye-stuff setting is obtained and that a migration of the dyestuffs is substantially avoided.

In a further embodiment of the present invention it is advantageous if a plurality of rope-like continuous filament groups or top slivers, for example about 8 to 24 tows and/or top slivers are lined up in parallel to form a material length of uniform thickness and if this material length is padded or printed, dried or Thermosol-dyed and subsequently and preferably washed and dried in one process. A very uniform material product at a minimum treatment time is obtained if the continuous filament groups are spread before the treatment to form a thin layer of uniform thickness and if they are subjected to the individual treatment processes, especially padding, drying and setting in this condition. It is of particular advantage if the tows or the top slivers, that is the material length which is formed is handled on a sieve drum, that is if it is at least partially dried and set on a sieve drum. The sieve drum ensures a safe and substantially trouble free material passage through the treatment chamber. In general, several sieve drums arranged one behind the other are used for drying and setting. This offers the special advantage that the material length is penetrated by the hot gas alternately due to the alternate guidance of the material on the sieve drums whereby the treatment effect is further equalized and improved.

Generally it is possible to feed the wet tows or top slivers which have been squeezed to a final moisture content about 60% to the drying and setting plant if the sieve drums are covered with at least one fine wire mesh so that the material does not rest directly on the sieve drums but rather on the wire mesh cover. This substantially avoids performation markings on the material being treated.

It is also possible and in some cases desirable if drying or at least pre-drying to a residual moisture content of about 20 to 30% is effected by blowing air on the material length, especially by means of a blower drum. The subsequent final drying and setting can then be effected by means of a suction draft, that is by conveying the material on one or several sieve drums subjected to a suction draft. The blower drum may also be designed as a sieve drum. In this drum, and in contrast to the suction drum, an excess pressure is built up in the sieve drum so that the hot treatment air flows out of the sieve drum and thus the material is freely guided on a cushion of air around the sieve drum. For pre-drying the material length it is also possible to arrange a jetting device at both sides of the material length between the padder and the sieve drum device. By using the jetting device the tows can be simultaneously spread to form a thin material length.

Texturized tows (crimped tows) can also be properly dyed according to the present process without the danger of a removal of the texture during the treatment. This can be achieved according to the present invention if the filament groups are guided without any tension during the heat-treatment and also during the subsequent cooling on at least one sieve drum subjected to a suction draft, and if the tows are overfed to the sieve drum and/or drums according to the amount of shrinkage of the material which occurs during the heat-treatment.

It is also possible, and in the case of smaller lots which have to be dyed advantageous if one or a few top slivers and/or one or a few rope-like filament groups (tows) are dyed using the Thermosol process. In this case the top slivers and/or the tows are folded after padding in a zig-zag like manner and transversely to the direction of material passage onto a conveying element of the treatment apparatus, particularly a sieve drum device. The material being treated, such as tow, may be folded on the inlet conveyor belt and then be dried. Thermosol-dyed and possibly further treated, for example washed and dried in the folded condition.

The apparatus for carrying out the process according to the present invention advantageously comprises a combination of a padding or printing device with a sieve drum treatment device containing sieve drums which are subjected to a suction draft and which are covered with at least one fine wire mesh. If several tows or top slivers are dyed simultaneously, a can feeding device for the corresponding number of tows and/or slivers is provided in front of the padder and a spreading device is disposed between the feeding device and the padder. On the spreading device the tows are spread to form a thin material length which is fed to the padder. The spreading device may consist of a number of bent tubes and/or at least one slotted nozzle which blows the treatment medium, particularly air against the tows. Furthermore, it is also expedient to provide suction drum bowls and another sieve drum dryer as well as a packing device behind the sieve drum device for drying and setting the tows and top slivers and to combine all of the units to a common control device so that the undyed material which is fed from cans is continuously treated and finally again packed into cans from where it is transported to further processing stages. Especially with tows which are to be dyed without or with only a very small amount of thickeners, it is advantageous to carry out the drying and/or pre-drying on blower drums and the setting on sieve drums subjected to a suction draft. With texturized materials only sieve drums subjected to a suction draft are used since only these drums ensure a completely tensionless material guidance.

In addition, it is also possible to set up a contact-free operating drying device, for example a high-frequency dryer, infrared rediators or a float-on-air dryer between the padder and the sieve drum treatment device for pre-drying the material. For the production of mixed yarns and to obtain the desired irregular pattern the tows and top slivers may be spread to form a thin material layer and may be printed with several colors. The printed materials are then developed according to the Thermosol process.

BRIEF DESCRIPTION OF THE DRAWINGS

The present invention will become more fully understood from the detailed description given hereinbelow and the accompanuing drawings which are given by way of illustration only and thus are not limitative of the present invention and wherein, FIG. 2 is a section of the sieve drum device acccording to the apparatus of FIG. 1 taken along the line A—A of FIG. 1.

DESCRIPTION OF THE PREFERRED EMBODIMENTS

Figure 1A:
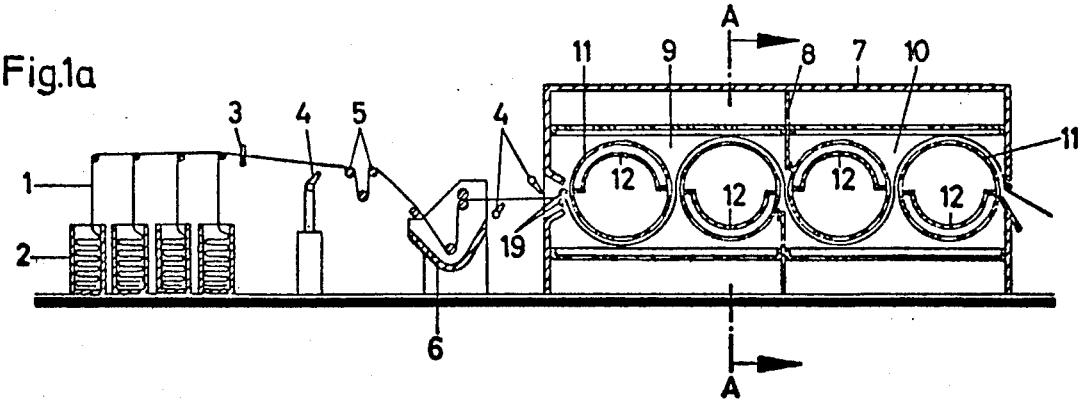
FIGS. 1*a* and 1*b* are a schematic design of a continuous dyeing plant for processing top slivers and tow.
Figure 1B:
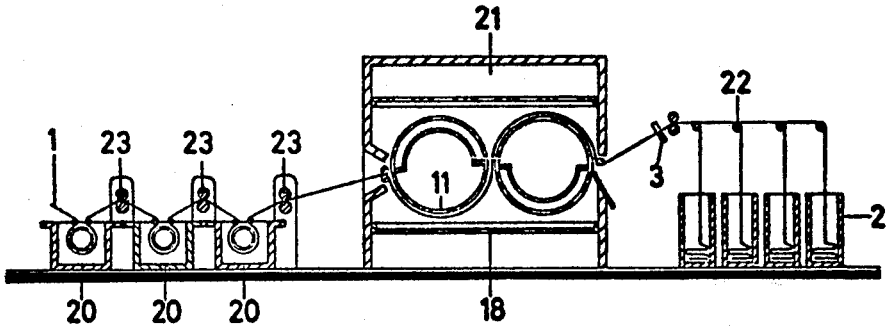
Figure 1B:
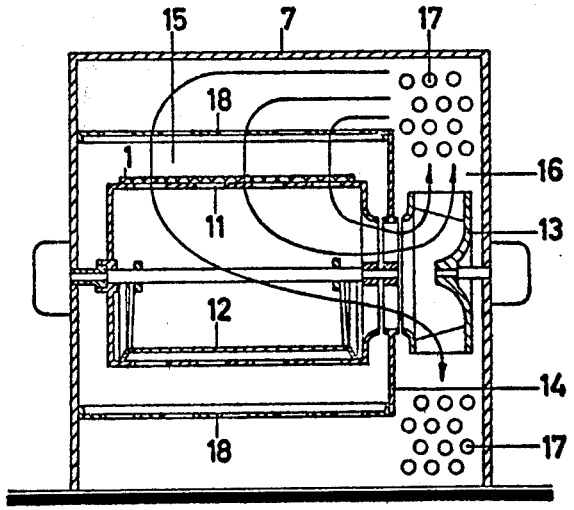

Referring now to the drawing wherein like references numerals are used throughout the various views to designate like parts, the apparatus comprises several tows 1 which are packed into cans 2, arranged in parallel by means of a rake-like element 3 and spread by means of a blowing device 4 and a spreading device 5 to form a thin material layer of uniform thickness. In many cases the use of a blowing device 4 or a mechanically operating spreading device 5 is sufficient for spreading the tows. The tows 1 are then fed to a padder 6, impregnated, for example with disperse dyestuffs and auxiliary agents and then fed to a sieve drum treatment plant 7. This plant is subdivided by a partition 8 into a drying chamber 9 and a setting chamber 10. Both chambers are equipped with sieve drums 11 subjected to a suction draft. The suction draft is interrupted at that portion of the sieve drums which are not covered with the material being treated by means of a baffle 12 so that the treatment medium, preferably air, is drawn through the material more intensely. A fan 13 is correlated to the face of each sieve drum. The sieve drum and fan are separated from each other by means of a partition 14 which subdivides the drying chamber 9 and the setting chamber 10 respectively into a treatment chamber 15 and a fan chamber 16. Above and beneath the fan means 13 heater batteries 17 are arranged for heating up the circulated treatment medium. For equalizing the air current, sieve sheets 18 are provided above and beneath the sieve drums. At the inlet of the sieve drum treatment plant 7 a pair of rollers 19 is arranged, the speed of which can be infinitely adjusted with respect to the feed of the sieve drums 11 so that the tows can be overfed to a desired degree to the first sieve drum. Generally the degree of overfeeding corresponds to the degree of material shrinkage during the treatment and/or the degree of shrinkage on the first sieve drum. By a graduation of the speeds of the individual sieve drums, the tows are pushed together and thus they are allowed to shrink again on the following sieve drum. By providing a large enough overfeeding a substantially tensionless material guidance on the sieve drums 12 subjected to a suction draft and full shrinkage of the material during the treatment is ensured. In this manner it is also possible to handle texturized tows properly without the texture being adversely affected. Instead of using hot air, the tows and top slivers can also be treated, that is dried and/or set with superheated steam or with a steam-air mixture.

For washing out the unfixed dyestuffs and auxiliary agents suction drum bowls 20 are provided and the material is subsequently dried on a sieve drum dryer 21 which is of the same design as the sieve drum treatment plant 7. After drying, the material length is again separated by means of a rake-like element 3 to form the individual top slivers and/or tows which are packed into cans 2 by means of a suitable packing device which in the drawings is only shown schematically by rolls 22. It is also possible to arrange conveyor belts between the individual units and between the suction drum bowl 20 and the squeezer 23 if a tensionless material guidance is also desired in this part of the treatment process.

The materials which can be treated by the process of the present invention include any of the synthetic filaments or blends of synthetic filaments with other synthetic filaments or cellulose filaments. The synthetic fibers may comprise synthetic polymers such as polyolefins, e.g., polyethylene, polypropylene, etc., polyamides, e.g., Nylon 6 obtained by the condensation of caprolactam, Nylon 66 obtained by the condensation of hexamethylenediamine with adipic acid, etc., polyesters, e.g., polyethylene terephthalate, etc., phenolic resins, e.g., phenol formaldehyde resins, urea formaldehyde resins, etc., polyvinyl materials, e.g., polyvinyl chloride, polyvinyl acetate, etc., acrylate resins, e.g., polymethylmethacrylate, copolymers of these materials with one another or with ethylenically unsaturated monomers, and similar type polymers. The present invention is particularly applicable to polyester fibers or blends of polyester fibers with, for example cellulose fibers.

The invention being thus described, it will be obvious that the same may be varied in many ways. Such variations are not to be regarded as a departure from the spirit and scope of the invention, and all such modifications are intended to be included within the scope of the following claims.

It is claimed:

1. A process for the continuous pad-dyeing or printing of groups of continuous filaments with disperse dyestuffs which set under the influence of heat, said filaments being selected from the group consisting of synthetic filaments selected from the group consisting of polyolefins, polyamides, polyesters, phenolic resins, polyvinyl materials, acrylate resins, and blends thereof and blends of said synthetic filaments with cellulose filaments, which comprises padding or printing the filament groups with a treatment liquor containing said dyestuffs, conveying said groups over at least one sieve drum means subjected to a suction draft, said sieve drum means being rotatably mounted in a treatment chamber, and drawing a gaseous treatment medium which has been heated to a temperature of about 170°–230° C. through the filament groups by said suction draft, said gaseous treatment medium being selected from the group consisting of hot air and a steam-air mixture and said filament groups being in the form of tows or top slivers.

2. The process of claim 1 wherein a plurality of said continuous filament groups are arranged in substantial parallel relationship with respect to each other to form a meterial length of uniform thickness, on said sieve drum means said material length being padded or printed, dried and Thermosol dyed and supsequently washed and dried in one continuous process.

3. The process of claim 1 wherein the continuous filament groups are initially spread to form a thin layer of uniform thickness before being treated by the treatment process.

4. The process of claim 1, wherein the filament groups are polyester fibers or blends of polyester fibers with other synthetic fibers or cellulose fibers.

5. The process of claim 1, wherein the filament groups are texturized tows and further comprising feeding said tows without tension over said sieve drum means whereby removal of the texture from said tow is prevented.

6. The process of claim 5, wherein said tows are overfed to the sieve drum means according to the amount of shrinkage of said tows that occurs during heat-treatment with said gaseous treatment medium.

7. A process for the continuous pad-dyeing or printing of continuous polyester filament groups which comprises impregnating the filament groups with disperse dyestuffs, drying and setting the dyestuffs on the filament groups by conveying said filament groups on at least one sieve drum means rotatably disposed in a treatment chamber and subjected to a suction draft and by drawing a gaseous treatment medium which has been heated to a temperature of about 170°–230° C. through said filament groups on said sieve drum means, removing said filament groups from said sieve drum means, washing out the unfixed dyestuffs and drying the dyed filament groups, said gaseous treatment medium being selected from the group consisting of hot air and a steam-air mixture and said filament groups being in the form of tows or top slivers.

8. The process of claim 7 wherein before impregnation the filament groups are arranged in substantial parallel relationship and spread to form a thin material layer of uniform thickness, and after final drying the material length is again separated to form individual filaments which are packed into suitable containers.

9. The process of claim 7 wherein drying and setting of the filament groups is effected on several sieve drum means arranged one behind the other, said filament groups being conveyed alternately on the surface of said sieve drum means

10. The process of claim 9 wherein the filament groups are dried and set on a fine wire mesh which substantially covers the conveying surface of the sieve drum means.

11. The process of claim 4 wherein pre-drying and additional spreading is effected by jetting the filament groups from both sides with air after impregnation but before drying and setting.

12. The process of claim 4 wherein the filament groups are overfed to the sieve drum means in the drying and setting stage of the process in an amount sufficient to compensate for the filament shrinkage during the heat-treatment, whereby the filament groups are conveyed tensionless on the sieve drum drums subjected to a suction draft during said heat-treatment.

13. The process of claim 9 wherein after impregnation, several tows or slivers are folded in a zig-zag fashion transversly to the direction of material passage on the conveying surface of said sieve drum means before being dried, Thermosol dyed and washed and dried in the folded condition.

14. The process of claim 9 wherein the filament groups are pre-dried to a residual moisture content of about 20–30% by blowing air against said filament groups using a blower sieve drum means the subsequent drying and setting being provided by said sieve drum means subjected to a suction draft.

15. The process of claim 14 wherein in the blower sieve drums an excess pressure is built up so that the hot treatment medium flows out of the drum providing a cushion around the drums for conveyance of the filament groups.

* * * * *